US011508510B2

(12) United States Patent
Xu et al.

(10) Patent No.: US 11,508,510 B2
(45) Date of Patent: Nov. 22, 2022

(54) INDUCTORS WITH CORE STRUCTURE SUPPORTING MULTIPLE AIR FLOW MODES

(71) Applicant: Eaton Intelligent Power Limited, Dublin (IE)

(72) Inventors: Zelin Xu, San Jose, CA (US); Mark A. Juds, New Berlin, WI (US); Jose Antonio Trujillo Rosales, Pewaukee, WI (US)

(73) Assignee: Eaton Intelligent Power Limited, Dublin (IE)

( * ) Notice: Subject to any disclaimer, the term of this patent is extended or adjusted under 35 U.S.C. 154(b) by 189 days.

(21) Appl. No.: 16/784,335

(22) Filed: Feb. 7, 2020

(65) Prior Publication Data

US 2020/0258671 A1 Aug. 13, 2020

Related U.S. Application Data

(60) Provisional application No. 62/803,069, filed on Feb. 8, 2019.

(51) Int. Cl.
*H01F 27/20* (2006.01)
*H01F 27/26* (2006.01)
*H01F 27/28* (2006.01)

(52) U.S. Cl.
CPC ..... *H01F 27/20* (2013.01); *H01F 27/263* (2013.01); *H01F 27/28* (2013.01)

(58) Field of Classification Search
CPC ..... H01F 27/20; H01F 27/263; H01F 27/28; H01F 17/062; H01F 27/085; H01F 27/2895; H01F 3/14
See application file for complete search history.

(56) References Cited

U.S. PATENT DOCUMENTS 3,451,023 A * 6/1969 Bull ..... H01F 29/146 336/212
3,868,082 A 2/1975 Soderqvist
(Continued)

FOREIGN PATENT DOCUMENTS

CN 101199032 6/2008
CN 103887904 6/2014
(Continued)

OTHER PUBLICATIONS

International Search Report and Written Opinion of the International Searching Authority; PCT/EP2020/025056; 12 pages.
(Continued)

*Primary Examiner* — Tuyen T Nguyen
(74) *Attorney, Agent, or Firm* — Stanek Lemon Crouse & Meeks, P.A.

(57) ABSTRACT

An inductor includes a plurality of stacked core parts having aligned central openings, at least one spacer separating the core parts from one another, and a winding comprising a plurality turns wound around the stack of core parts through central openings of the core parts. The at least one spacer may include respective groups of spacers disposed between respective pairs of the core parts. In some embodiments, the at least one spacer may include a plurality of spacers disposed between first and second ones of the core parts and radially distributed in a circular pattern aligned with the first and second core parts.

11 Claims, 7 Drawing Sheets

(56) References Cited

U.S. PATENT DOCUMENTS

| | | | | |
|---|---|---|---|---|
| 4,603,314 | A | 7/1986 | Fukunaga et al. | |
| 4,649,639 | A | 3/1987 | Mas | |
| 4,975,672 | A | 12/1990 | McLyman | |
| 5,165,162 | A | 11/1992 | Charles | |
| 6,162,311 | A | 12/2000 | Gordon et al. | |
| 6,512,438 | B1 | 1/2003 | Yoshimori et al. | |
| 7,573,362 | B2 | 8/2009 | Thiel et al. | |
| 7,710,228 | B2 | 5/2010 | Feng et al. | |
| 7,808,359 | B2 | 10/2010 | Rao | |
| 7,990,244 | B2 | 8/2011 | Huss et al. | |
| 8,154,372 | B2 | 4/2012 | Feng et al. | |
| 8,922,311 | B2 | 12/2014 | Pal et al. | |
| 9,496,085 | B2 | 11/2016 | Pal et al. | |
| 2002/0175571 | A1 | 11/2002 | Gilmore et al. | |
| 2004/0227606 | A1 | 11/2004 | Lin et al. | |
| 2013/0257574 | A1 | 10/2013 | Downing et al. | |
| 2014/0320226 | A1* | 10/2014 | Takahashi | H03F 3/24 332/149 |
| 2015/0287517 | A1 | 10/2015 | Xie et al. | |

FOREIGN PATENT DOCUMENTS

| | | |
|---|---|---|
| CN | 204332587 | 5/2015 |
| CN | 106158250 | 11/2016 |
| CN | 106298162 | 1/2017 |
| CN | 107293389 | 10/2017 |
| DE | 2237251 | 2/1974 |
| DE | 10042573 | 2/2002 |
| EP | 2061043 | 5/2009 |
| JP | 2017152549 | 8/2017 |
| KR | 199408890 | 9/1994 |
| KR | 1101676 | 12/2011 |
| KR | 2013032102 | 4/2013 |
| WO | WO2013106957 | 2/2012 |

OTHER PUBLICATIONS

International Preliminary Report of Patentability for PCT/EP2020/025056, dated Aug. 19, 2021, 8 pages.

* cited by examiner

INDUCTORS WITH CORE STRUCTURE SUPPORTING MULTIPLE AIR FLOW MODES

RELATED APPLICATION

The present application claims the benefit of U.S. Provisional Patent Application Ser. No. 62/803,069 entitled "High-Frequency High-Power Inductors with Low-Temperature Winding and Cores," filed Feb. 9, 2019 and incorporated herein by reference in its entirety.

BACKGROUND

The inventive subject matter relates to electric circuit components and, more particularly, to inductors.

Wide bandgap power semiconductors have enabled high frequency switching operations of power electronic devices. These high switching frequencies can create high frequency ripple currents that need to be controlled (minimized, attenuated, reduced). Power inductors are frequently used to reduce these ripple currents. One challenge frequently encountered by high-frequency filter inductors with high power ratings is high losses. As a result, the core and winding temperatures can be very high.

A very common inductor topology is a toroid core with evenly distributed winding turns. The core is usually made of powdered materials with distributed gaps to store energy. Other magnetic materials and air gaps can also be used. The conductor can be round wires or Litz wires. Recently, vertical winding using flat wire has been used to reduce winding temperature, reduce skin effect, reduce turn-to-turn stray capacitance, and improve electromagnetic compatibility. But the core temperature can still be high when using such inductors in high-frequency, high-power applications.

There are several solutions to reduce core temperature. One solution is to use larger cores to reduce magnetic flux density, but this can increase inductor cost. A second solution is to use low-loss powder cores, but these cores often have low saturation flux density and low DC bias performance and tend to be more expensive, so the result again can be a larger and more expensive core. A third solution is the use of advanced cooling configurations, but this solution may require more cooling power and cooling space.

SUMMARY

Some embodiments of the inventive subject matter provide an inductor including a plurality of stacked core parts having aligned central openings, at least one spacer separating the core parts from one another, a winding comprising a plurality of turns wound around the stack core parts through central openings of the core parts. In some embodiments, the at least one spacer may include respective groups of spacers disposed between respective pairs of the core parts. In some embodiments, the spacers may be disc-shaped. In further embodiments, the at least one spacer may include a plurality of spacers disposed between first and second ones of the core parts and radially distributed in a circular pattern aligned with the first and second core parts.

In some embodiments, the inductor may further include a plug spacer disposed between a major surface of one of the core parts and the winding and configured to deflect an air flow through the central openings of the core parts. The plug spacer may include a disc having a plurality of slots therein that receive respective turns of the winding.

In further embodiments, the at least one spacer may include a plurality of spacers, each of which includes a first portion disposed in a gap between adjacent ones of core parts and a second portion extending from the first portion and disposed between adjacent turns of the winding. The spacers may include a thermally conductive and electrically insulating material. Each spacer may further include a third portion extending from the first portion and having at least a portion disposed in central openings of the adjacent core parts.

Some embodiments provide an inductor including a first core part, a second core part having a central opening aligned with a central opening of the first core part, a winding wound around the first and second core parts through the central openings thereof, and a plurality of spacers disposed between the first and second core parts and radially distributed in a circular pattern aligned with the first and second core parts. The spacers may be disposed at openings between adjacent turns of the windings. Each of the spacers may include a portion that extends between adjacent turns of the winding.

Still further embodiments provide an inductor including a first core part, a second core part having a central opening aligned with a central opening of the first core part, a winding wound around the first and second core parts and through the central openings thereof, a plurality of spacers disposed between the first and second core parts, and a plug spacer disposed between a major surface of the first core part and the winding and configured to deflect an air flow through the central openings of the first and second core parts. The plug spacer may include a disc having a plurality of slots therein that receive respective turns of the winding.

DETAILED DESCRIPTION

Figure 1:
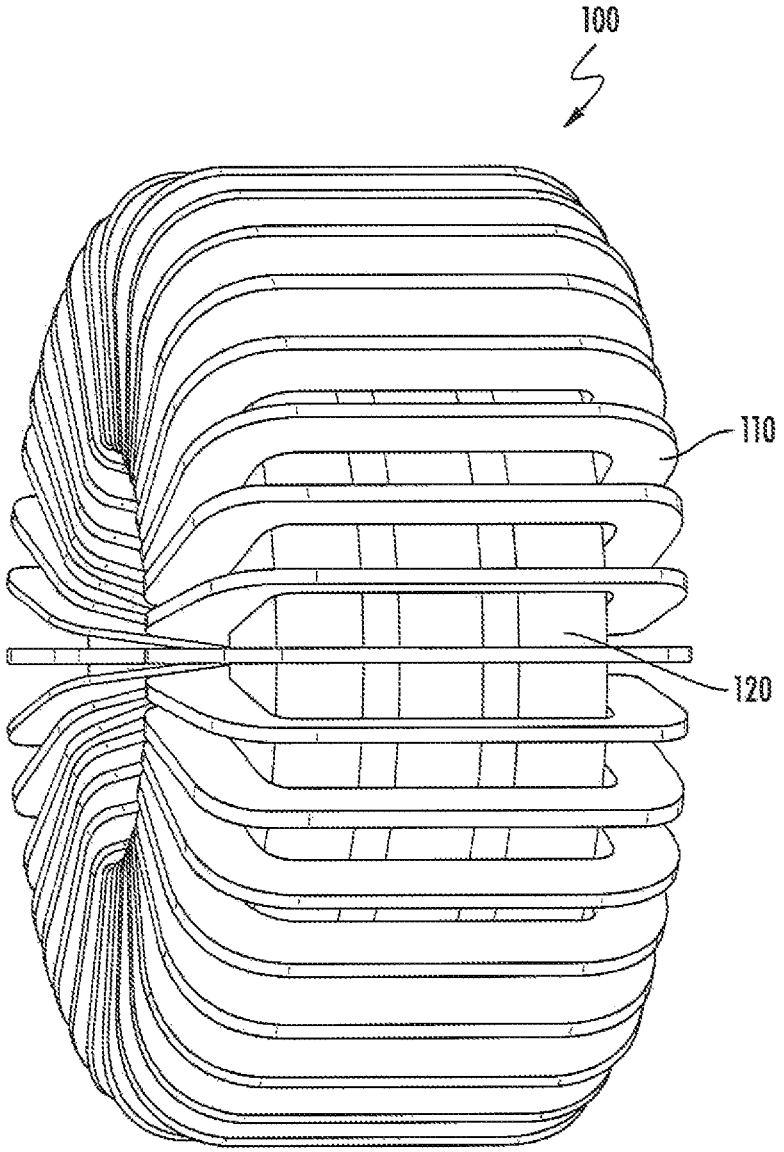
FIG. 1 is a perspective view of an inductor according to some embodiments.

Specific exemplary embodiments of the inventive subject matter now will be described with reference to the accompanying drawings. This inventive subject matter may, however, be embodied in many different forms and should not be construed as limited to the embodiments set forth herein; rather, these embodiments are provided so that this disclosure will be thorough and complete, and will fully convey the scope of the inventive subject matter to those skilled in the art. In the drawings, like numbers refer to like items. It will be understood that when an item is referred to as being "connected" or "coupled" to another item, it can be directly connected or coupled to the other item or intervening items may be present. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, items, and/or components, but do not preclude the presence or addition of one or more other features, integers, steps, operations, items, components, and/or groups thereof.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the specification and the relevant art and will not be interpreted in an idealized or overly formal sense unless expressly so defined herein.

In some embodiments, an inductor is designed with concentric toroidal core parts stacking together having gaps between each other supported by smaller spacers, and with vertical winding using flat conducting strip disposed in a helical coil configuration of circular shape. The gaps between toroidal magnetics core parts provides additional heat transfer areas and cooling channels that can substantially reduce the core temperature especially for high-frequency high-power applications. Some embodiments provide cooling configurations that can reduce both winding and core temperature. It will be appreciated that such advantages may also be achieved using core parts that have other shapes, such as rectangular or elliptical core parts with central openings or windows through which windings pass.

Some embodiments of the inventive concept can reduce the core temperature without increasing the core size, cost, and may require much less cooling power as compared to similar designs. This can be done by dividing the core into two or more toroidal parts in parallel, with spacers in between the toroidal parts.

Figure 2:
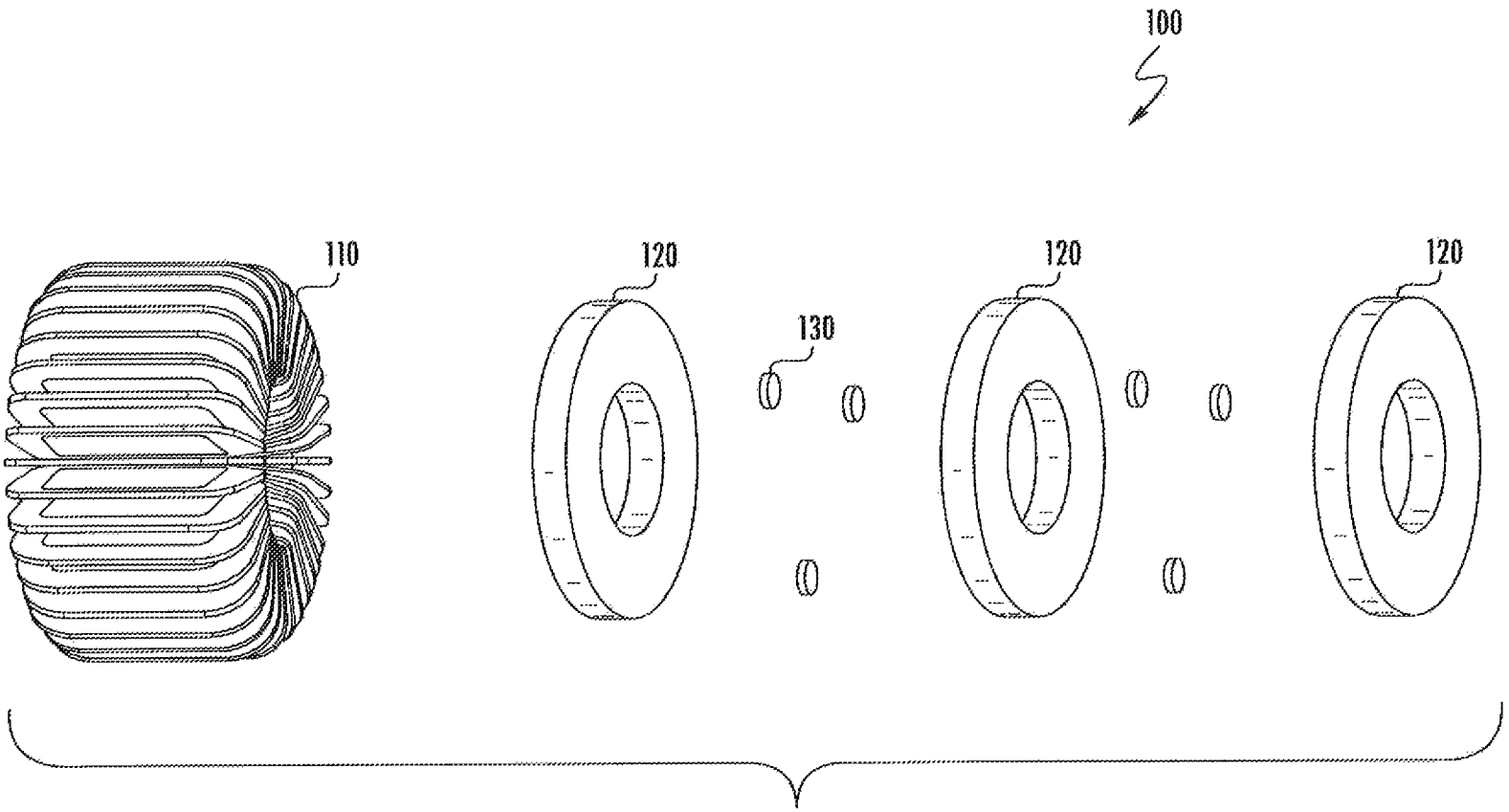
FIG. 2 is an exploded view of the inductor of FIG. 1.
Figure 3:
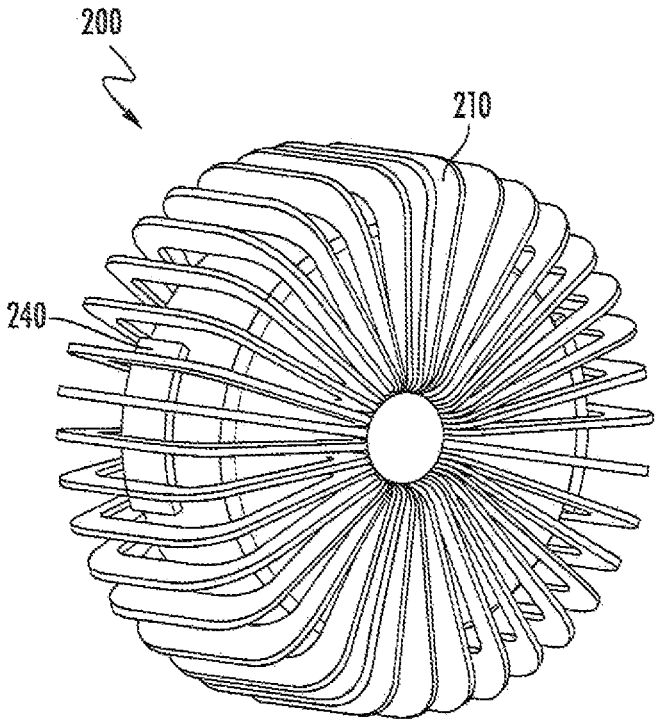
FIG. 3 is a perspective view of an inductor according to some embodiments.
Figure 4:
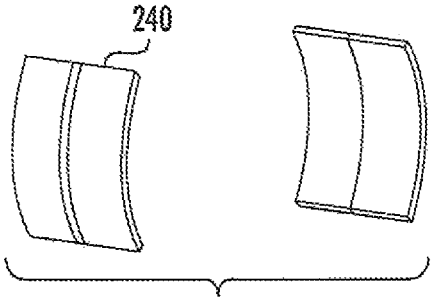
FIG. 4 is a perspective view of air flow deflecting shields of the inductor of FIG. 3.
Figure 5:
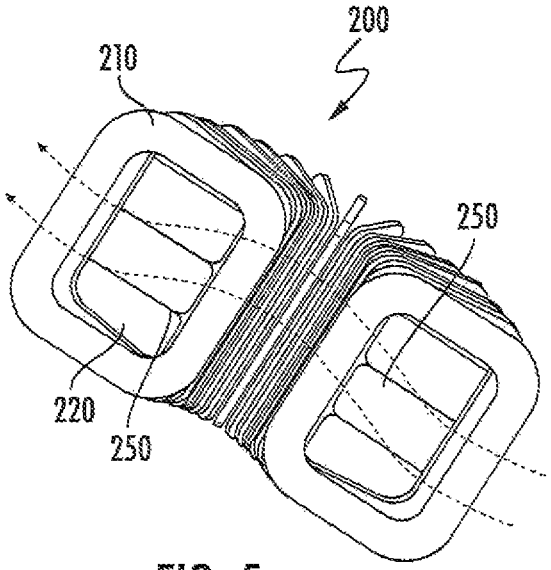
FIG. 5 is a cutaway view of the inductor of FIG. 3 illustrating exemplary airflow therethrough.
Figure 6:
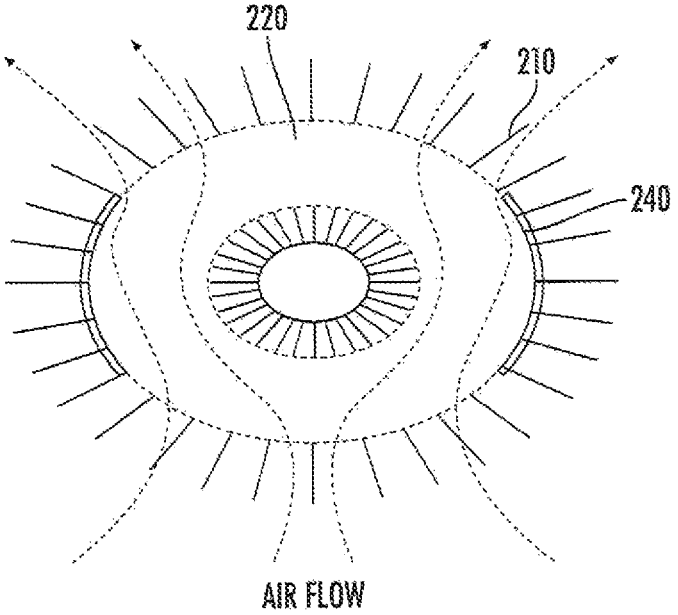
FIGS. 6 and 7 illustrate airflows of the inductor of FIG. 3 without and with a ducted fan, respectively.

FIGS. 1 and 2 illustrate an inductor 100 according to some embodiments. Air gaps between the toroidal core parts 120 create additional heat transfer areas, and thus significantly increases the heat transfer and reduces the core temperature. In addition, these small air gaps are parallel to the magnetic flux path, having no effect on the effective permeability of the core. This is different from the gaps perpendicular to the flux path, which is used to control the effective permeability of the core. This enables a very small inductor design without increasing the cooling needs. At the same cooling condition, this reduces the core and winding material used, and greatly reduces the cost as compared to single-core no-gap designs.

The core parts 120 can be made of powder materials with distributed gaps to control the magnetic permeability. They can also be made of other materials like ferrites, or amorphous materials with discrete gaps (normal to the circumferential direction to control the magnetic permeability), or next generation materials like nanocrystalline magnetics with tunable permeability. Spacers 130 can be made of any material, since they are not directly in the magnetic flux path. The spacers 130 can also be made of a dielectric non-magnetic material with a relative permeability close to that of air, to concentrate the magnetic flux in the core and minimize stray and/or leakage flux and minimize additional losses in the spacers due to eddy currents and core losses. The spacers 130 are shown as small round discs, but the spacers 130 may also be larger and non-circular with a perimeter ridge or fin and made of a high thermal conductivity material to increase the heat transfer area. The winding 110 can be made of copper, aluminum, or other conductors, which may have various different shapes, such as round wires, flat (ribbon-like) wires, Litz wires, etc. It can have one turn, and as many turns as allowed by the core window size. The turns of the winding 110 are uniformly distributed circumferentially around the toroid shaped core parts 120. With no discrete gap in the core, the magnetic flux is confined within the core. As a result, the inductor has minimal stray flux. The winding 110 has little parasitic capacitance. It also has large heat transfer area and fin-type configuration, which reduces winding temperature and allows high current-density designs. Although toroidal core parts 120 are shown, it will be appreciated that some embodiments may use core parts with other shapes, such as rectangular or elliptical core parts with similar core windows through which windings may pass.

Such a design can be suitable for both natural convection and forced convection cooling conditions. Natural convection cooling can be used for designs which have relatively low heat losses. For this case, the inductor 100 can be positioned either horizontally or vertically or with any angle in between, depending on the loss distribution between the winding and the core parts. For example, if the winding loss is the primary loss, then a horizontal positioning (axis of winding 110 oriented upward) can be used; if the core loss is high, then a vertical positioning (axis of winding 110 oriented sideways) can be used.

Forced convection cooling can be used for designs with relatively high heat losses. Fans can be used to blow air toward the inductor. This inductor design can accommodate multiple cooling scenarios. A few of the scenarios will be described here with reference to FIGS. 3-7, which illustrate an inductor 200 according to further embodiments.

Figure 7:
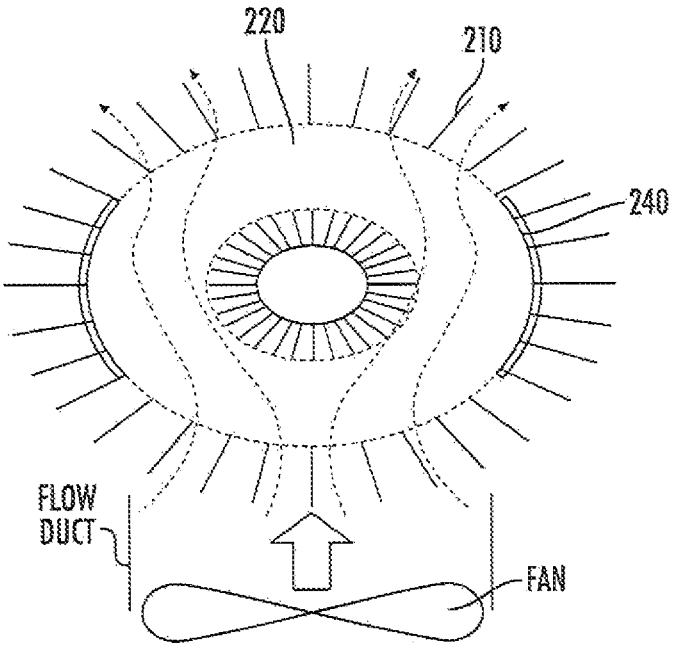

In a first scenario, the air flow direction is parallel to toroidal core parts 220. Spacers between the toroidal core parts 220 should be small to reduce or minimize blockage of air flow. The winding 210 with flat wire creates inlet and outlet passages for cooling air to flow through the airgaps 250 between the toroidal core parts 220 and cool the core. The cooling air enters the air gaps 250 via the openings between turns of the winding 210 on the upwind side of the winding 210, and then exits the air gaps 250 through openings in the winding 210 around the toroidal core parts 220. It may be desirable to duct the air through the air gaps 250 and make it exit at a leeward side of the inductor 200. Flow shields 240 can be placed at the sides of the toroidal core parts 220, as shown. This shields 240 can be, for example, tapes that block the flow path; they can also be made of structurally strong materials which not only block the flow path, but also provide mechanical support. As shown in FIG. 7, a flow duct for a fan can also be used to force air through the inductor and enhance cooling. If the winding 210 is tightly wound, air would enter from the upwind side, flow through the air gaps, and exit at the leeward side. If there are gaps in between winding turns within the core window, air would enter from the upwind side, go through the air gaps between toroidal core parts 220 as well as the gaps between turns of the winding 210, and exit from the leeward side. In either case, the heat transfer is enhanced because of the increased heat transfer area in the air gaps between the toroidal core parts 220, and hence the core temperature is reduced. Also, the air gaps between the toroidal core parts 220 allows air to flow through and increases the air flow across the winding 210 on the leeward side of the toroidal core parts 220, so that the winding temperature can be further reduced.

Figure 8:
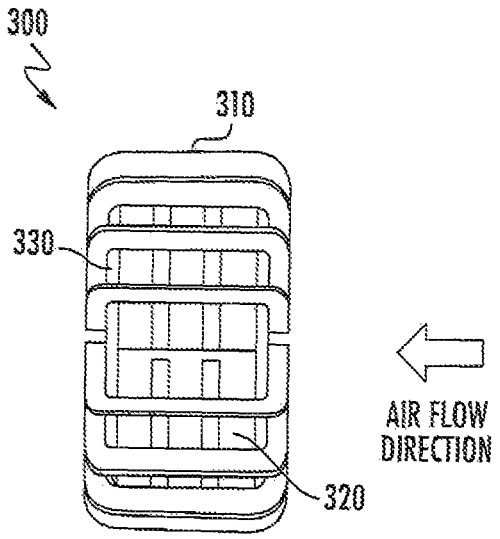
FIG. 8 is a side view of an inductor according to some embodiments.
Figure 9:
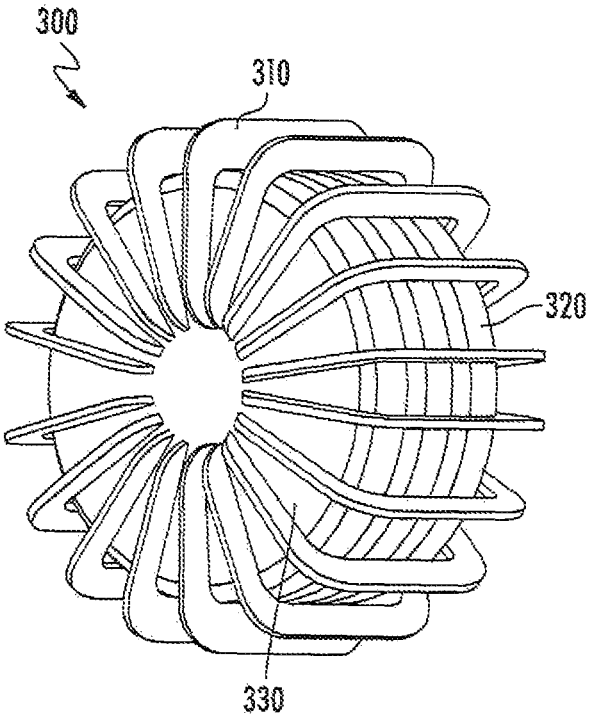
FIG. 9 is a perspective view of the inductor of FIG. 8.
Figure 10:
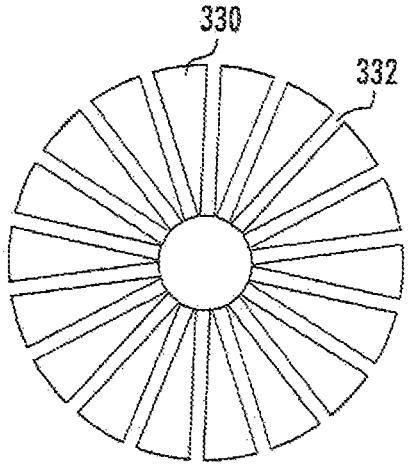
FIG. 10 is a top view of a plug spacer of the inductor of FIG. 8.

FIGS. 8-10 illustrate an inductor 300 according to further embodiments, suitable for scenarios in which air flow direction is perpendicular to toroidal core parts 320. This can be used for designs which have a winding 310 with relatively fewer turns so that adjacent turns do not touch inside a window in the toroidal core parts 320. In this case, the winding 310 enjoys relatively high air flow, because all of the winding turns receive direct air flow. However, the air flow direction is perpendicular to the air gaps between toroidal core parts 320. To duct the air flow through the air gaps between the toroidal core parts 320, a plug spacer 330 can be used. The plug spacer 330 may include teeth with slots that provide clearance for the turns of the winding 310. The plug spacer 330 can be placed at the leeward side of the inductor 300, with teeth inserted in between the turns of the winding 310, thus blocking the flow path through the core window. Because of the blockage, air flow will change direction and exit through the air gaps between the toroidal core parts 320. Because the pressure drop from the inlet of the core window to the plug spacer 330 in the original flow direction is small, each air gap may receive approximately the same amount of air, thus enabling a fairly uniform temperature distribution across the toroidal core parts 320.

Figure 11:
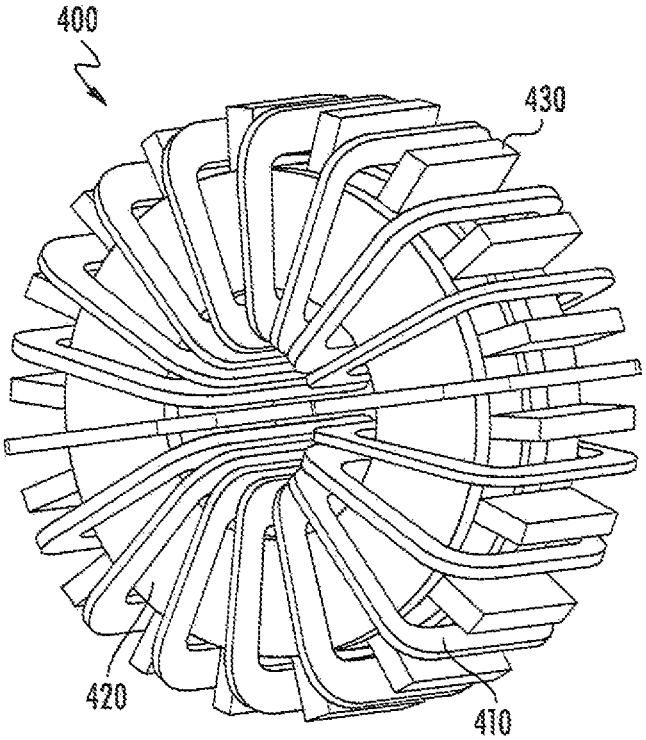
Figure 12:
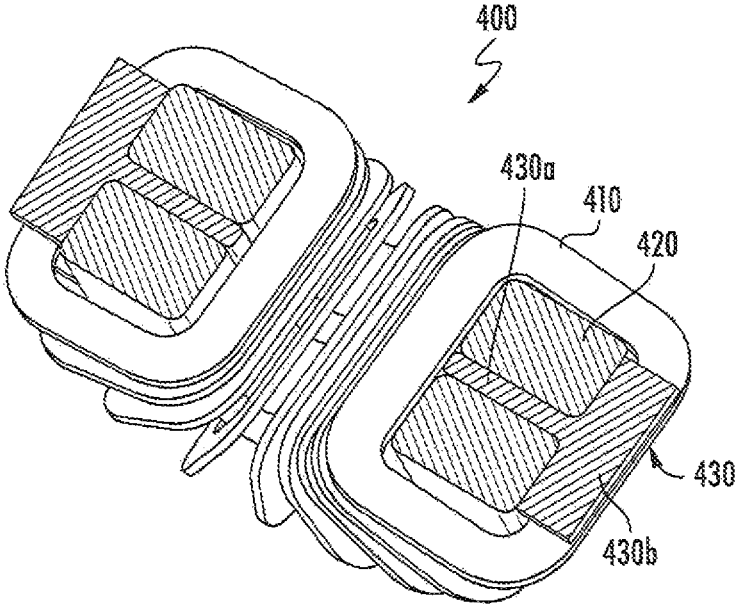
FIG. 12 is a cutaway view of the inductor of FIG. 11.

FIGS. 11 and 12 illustrate an inductor 400 according to further embodiments. Instead of having air gaps in between toroidal core parts 420, thermally conductive spacers 430 are placed there, sandwiched by the toroidal core parts 420. The spacers 430 have fin-type wings 430*b* that are positioned between the turns of a winding 410, and parallel to the conductors of the winding 410. As a result, heat is passed from the toroidal core parts 420 to the spacer 430*a* and dissipated through the wings 430*b* by air flow. The spacers 430 can be made of thermally conductive material but also electrically insulate to minimize eddy current heating.

Figure 13:
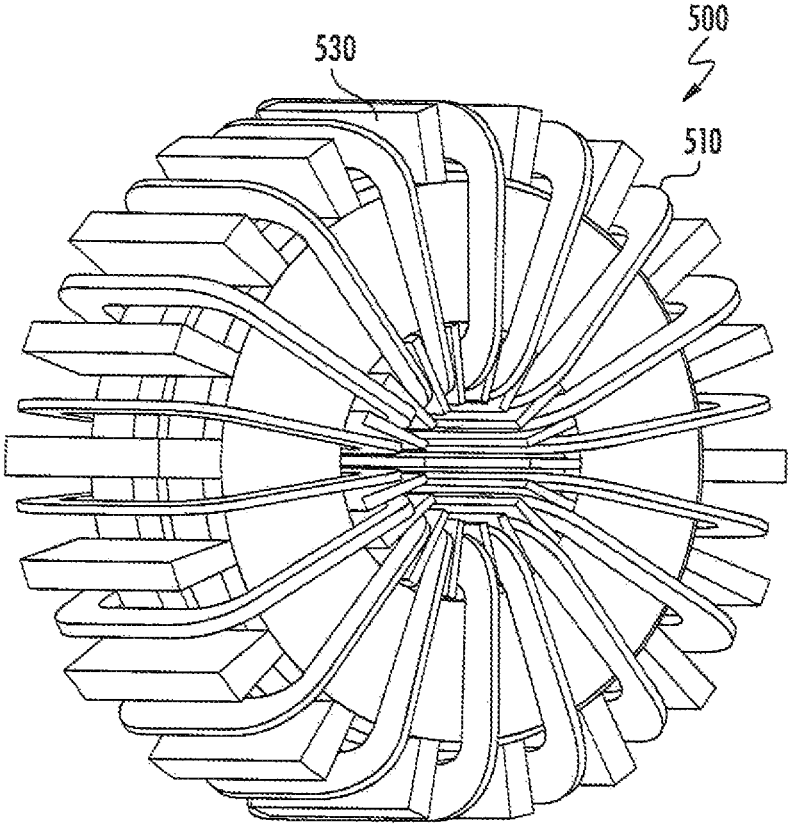
FIG. 13 is a perspective view of an inductor according to some embodiments.
Figure 14:
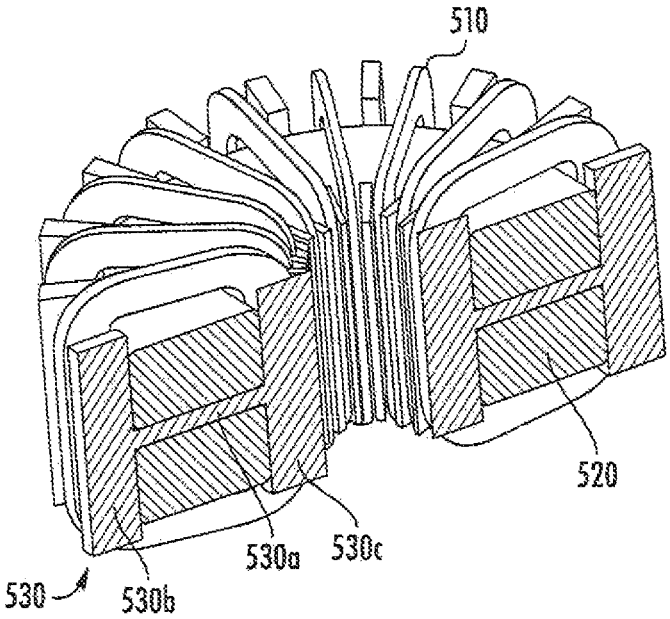
FIG. 14 is a cutaway view of the inductor of FIG. 13.

According to embodiments illustrates in FIGS. 13 and 14, spacers 530 of an inductor 500 with winding 510 and toroidal core parts 520. The inductor 500 includes spacers 530 that separate the toroidal core parts 520. The spacers 530 include outside fins 530*b* similar to the fins 430*b* of the inductor 400 of FIGS. 11 and 12, along with inside fins 530*c* that can also be used both as heat remover and as electrical isolation.

The drawings and specification, there have been disclosed exemplary embodiments of the inventive subject matter. Although specific terms are employed, they are used in a generic and descriptive sense only and not for purposes of limitation, the scope of the inventive subject matter being defined by the following claims.

That which is claimed:

1. An inductor comprising:

a plurality of stacked core parts having aligned central openings;

a winding comprising a plurality turns wound around the stack of core parts through central openings of the core parts; and a plurality of spacers separating the core parts from one another, each of which comprises a first portion disposed between adjacent ones of the core parts and a second portion extending from the first portion and disposed in respective gaps between adjacent ones of the turns.

2. The inductor of claim 1, wherein the spacers are radially distributed in a circular pattern aligned with the first and second core parts.

3. The inductor of claim 1, further comprising a plug spacer disposed between a major surface of one of the core parts and the winding and configured to deflect an air flow through the central openings of the core parts.

4. The inductor of claim 3, wherein the plug spacer comprises a disc having a plurality of slots therein that receive respective turns of the winding.

5. The inductor of claim 1, wherein the spacers comprise a thermally conductive and electrically insulating material.

6. The inductor of claim 1, wherein each spacer of the plurality of spacers further comprises a third portion extending from the first portion and having at least a portion disposed in central openings of the adjacent core parts.

7. An inductor comprising:

a first core part;

a second core part having a central opening aligned with a central opening of the first core part;

a winding wound around the first and second core parts through the central openings thereof and comprising a plurality of turns distributed around the first and second core parts; and a plurality of spacers disposed between the first and second core parts, radially distributed in a circular pattern aligned with the first and second core parts and disposed at respective gaps between adjacent turns of the windings.

8. The inductor of claim 7, wherein the spacers respectively comprise portions separating adjacent turns of the winding.

9. The inductor of claim 7, wherein each of the spacers comprises:

a first portion disposed between the first and second core parts; and a second portion extending from the first portion and disposed between adjacent turns of the winding.

10. The inductor of claim 9, wherein each of the spacers further comprises a third portion extending from the first portion and disposed in the central openings of the first and second core parts.

11. The inductor of claim 7, wherein the spacers comprise a thermally conductive and electrically insulating material.

* * * * *